US011756780B2

(12) United States Patent
Oser et al.

(10) Patent No.: US 11,756,780 B2
(45) **Date of Patent: *Sep. 12, 2023**

(54) MULTIPOLE ASSEMBLY CONFIGURATIONS FOR REDUCED CAPACITIVE COUPLING

(71) Applicant: Thermo Finnigan LLC, San Jose, CA (US)

(72) Inventors: Harald Oser, San Carlos, CA (US); Raman Mathur, Mountain View, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/541,086

(22) Filed: Dec. 2, 2021

(65) Prior Publication Data

US 2022/0230862 A1 Jul. 21, 2022

Related U.S. Application Data

(63) Continuation of application No. 16/808,244, filed on Mar. 3, 2020, now Pat. No. 11,201,044.

(51) Int. Cl.
*H01J 49/06* (2006.01)
*H01J 49/42* (2006.01)

(52) U.S. Cl.
CPC ..... *H01J 49/063* (2013.01); *H01J 49/065* (2013.01); *H01J 49/4225* (2013.01)

(58) Field of Classification Search
CPC ..... H01J 49/063; H01J 49/065; H01J 49/4225
USPC ..... 250/281, 282, 283
See application file for complete search history.

(56) References Cited

U.S. PATENT DOCUMENTS

| | | | | |
|---|---|---|---|---|
| 7,189,967 | B1 | 3/2007 | Whitehouse et al. | |
| 8,212,208 | B2 | 7/2012 | Green et al. | |
| 8,426,803 | B2 | 4/2013 | Green et al. | |
| 9,230,788 | B2 | 1/2016 | Okumura et al. | |
| 9,343,285 | B2 | 5/2016 | Green et al. | |
| 9,934,954 | B2 | 4/2018 | Schlueter | |
| 10,204,773 | B2 | 2/2019 | Sugiyama et al. | |
| 11,201,044 | B2 * | 12/2021 | Oser | H01J 49/4225 |

(Continued)

FOREIGN PATENT DOCUMENTS

| | | | |
|---|---|---|---|
| JP | S6182653 | A | 4/1986 |
| WO | 20200121257 | A1 | 6/2020 |

OTHER PUBLICATIONS

Collings et al. "Reducing Ion Reflections at the Quadrupole Prefilter/mass fliter Boundary: Simulation and Experiment" Rapid Communications in Mass Spectrometry, Mar. 12, 2019, vol. 33, Issue No. 10, pp. 925-934.

(Continued)

*Primary Examiner* — Nicole M Ippolito
(74) *Attorney, Agent, or Firm* — Klarquist Sparkman, LLP

(57) ABSTRACT

A first multipole assembly includes a first plurality of rod electrodes arranged about an axis and configured to confine ions radially about the axis. A second multipole assembly disposed adjacent to the first multipole assembly includes a second plurality of rod electrodes arranged about the axis and configured to confine the ions radially about the axis. An orientation of the first multipole assembly about the axis is rotationally offset relative to an orientation of the second multipole assembly about the axis.

20 Claims, 9 Drawing Sheets

(56) References Cited

U.S. PATENT DOCUMENTS

| | | | | |
|---|---|---|---|---|
| 2011/0049358 | A1* | 3/2011 | Green | H01J 49/4225 250/283 |
| 2017/0213717 | A1 | 7/2017 | Schlueter | |

OTHER PUBLICATIONS

Du et al. "A Novel Tandem Quadrupole Mass Analyzer," Journal of the American Society for Mass Spectrometry, Nov. 1999, vol. 10, pp. 1053-1066.
"Multipole Ion Guide," Uploaded by Mass Spec Pro on Aug. 4, 2015, 8 pages.
EP Extended Search Report dated Jul. 9, 2021, to EP Patent Application No. 21159901.4.

* cited by examiner

MULTIPOLE ASSEMBLY CONFIGURATIONS FOR REDUCED CAPACITIVE COUPLING

CROSS-REFERENCE TO RELATED APPLICATION

This application is a continuation of U.S. application Ser. No. 16/808,244, filed on Mar. 3, 2020, the disclosure of which is incorporated herein by reference.

BACKGROUND INFORMATION

A mass spectrometer is an analytical tool that may be used for qualitative and/or quantitative analysis of a sample. A mass spectrometer generally includes an ion source for generating ions from the sample, a mass analyzer for separating the ions based on their ratio of mass to charge, and an ion transfer device for transferring ions generated by the ion source to the mass analyzer. The mass spectrometer uses data from the mass analyzer to construct a mass spectrum that shows a relative abundance of each of the detected ions as a function of their ratio of mass to charge. By analyzing the mass spectrum generated by the mass spectrometer, a user may be able to identify substances in a sample, measure the relative or absolute amounts of known components present in the sample, and/or perform structural elucidation of unknown components.

The ion transfer device and/or the mass analyzer may include one or more multipole assemblies having a plurality of electrodes. These multipole assemblies serve the function of guiding, trapping, and/or filtering ions. As an example, a multipole assembly may be a quadrupole having four rod electrodes arranged as two pairs of opposing rod electrodes. Opposite phases of radio-frequency (RF) voltage may be applied to the pairs of rod electrodes, thereby generating a quadrupolar electric field that guides or traps ions within a center region of the quadrupole.

In quadrupole mass filters, a mass resolving direct current (DC) voltage may also be applied to the pairs of rod electrodes, thereby superimposing a DC electric field on the quadrupolar electric field and causing a trajectory of some ions to become unstable and thereby causing the ions to discharge against one of the rod electrodes. In such mass filters, only ions having a certain ratio of mass to charge maintain a stable trajectory and are subsequently detected by the ion detector.

When a multipole assembly is used in a mass spectrometer, an imprecise electric field generated by the multipole assembly may cause poor transmission of ions and result in diminished resolution, sensitivity, and/or mass accuracy.

SUMMARY

The following description presents a simplified summary of one or more aspects of the methods and systems described herein in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects of the methods and systems described herein in a simplified form as a prelude to the more detailed description that is presented below.

In some exemplary embodiments, a mass spectrometer comprises a first multipole assembly comprising a first plurality of rod electrodes arranged about an axis and configured to confine ions radially about the axis, and a second multipole assembly adjacent to the first multipole assembly and comprising a second plurality of rod electrodes arranged about the axis and configured to confine the ions radially about the axis, wherein an orientation of the first multipole assembly about the axis is rotationally offset relative to an orientation of the second multipole assembly about the axis.

In some exemplary embodiments, the orientation of the first multipole assembly about the axis is rotationally offset relative to the orientation of the second multipole assembly about the axis such that a rod electrode included in the first plurality of rod electrodes overlaps with two rod electrodes included in the second plurality of rod electrodes, as viewed in a direction along the axis.

In some exemplary embodiments, the amount of overlap of the rod electrode included in the first plurality of rod electrodes with each of the two rod electrodes included in the second plurality of rod electrodes is substantially the same, as viewed in the direction along the axis.

In some exemplary embodiments, the orientation of the first multipole assembly about the axis is rotationally offset relative to the orientation of the second multipole assembly about the axis such that a net voltage capacitively coupled to a rod electrode included in the first plurality of rod electrodes by the second plurality of rod electrodes is approximately zero.

In some exemplary embodiments, the orientation of the first multipole assembly about the axis is rotationally offset relative to the orientation of the second multipole assembly about the axis such that a rod electrode included in the first plurality of rod electrodes does not overlap with any rod electrodes included in the second plurality of rod electrodes, as viewed in a direction along the axis.

In some exemplary embodiments, an orientation of the first plurality of rod electrodes about the axis is radially offset relative to the orientation of the second plurality of rod electrodes about the axis.

In some exemplary embodiments, each of the first multipole assembly and the second multipole assembly comprises an ion guide, a mass filter, an ion trap, or a collision cell.

In some exemplary embodiments, the mass spectrometer further comprises an ion source and a mass analyzer, wherein the first multipole assembly is included in the ion source and the second multipole assembly is included in the mass analyzer.

In some exemplary embodiments, an interface between the first multipole assembly and the second multipole assembly does not include a lens.

In some exemplary embodiments, the first multipole assembly and the second multipole assembly are spaced apart by no more than approximately 5.0 millimeters (mm) and no less than approximately 0.5 mm.

In some exemplary embodiments, the first multipole assembly and the second multipole assembly are spaced apart by no more than approximately 3.0 mm and no less than approximately 0.5 mm.

In some exemplary embodiments, a multipole assembly configured for use in a mass spectrometer comprises a first plurality of rod electrodes arranged about an axis and configured to confine ions radially about the axis, wherein the mass spectrometer includes another multipole assembly comprising a second plurality of rod electrodes arranged about the axis and configured to confine the ions radially about the axis, and when the multipole assembly is disposed adjacent to the another multipole assembly in the mass spectrometer, an orientation of the first multipole assembly about the axis is rotationally offset relative to an orientation of the second multipole assembly about the axis.

In some exemplary embodiments, a method includes disposing a first multipole assembly in a mass spectrometer, the first multipole assembly comprising a first plurality of rod electrodes arranged about an axis and configured to confine ions radially about the axis; and disposing a second multipole assembly in the mass spectrometer adjacent to the first multipole assembly, the second multipole assembly comprising a second plurality of rod electrodes arranged about the axis and configured to confine the ions radially about the axis, wherein the second multipole assembly is disposed in the mass spectrometer such that an orientation of the second multipole assembly about the axis is rotationally offset relative to an orientation of the first multipole assembly about the axis.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements. Furthermore, the figures are not necessarily drawn to scale as one or more elements shown in the figures may be enlarged or resized to facilitate recognition and discussion.

DETAILED DESCRIPTION

Figure 1:
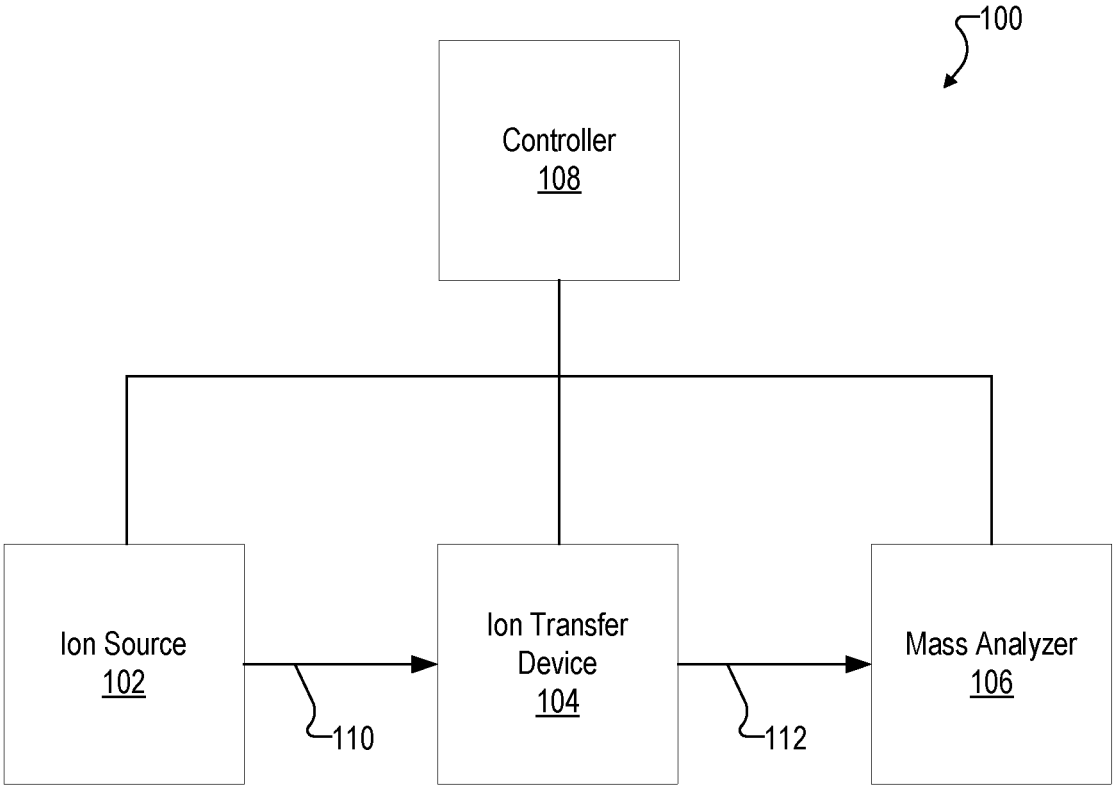
FIG. 1 illustrates functional components of an exemplary mass spectrometer system.

As will be described herein in detail, a mass spectrometer includes a first multipole assembly and a second multipole assembly adjacent to the first multipole assembly. The first multipole assembly includes a first plurality of rod electrodes arranged about an axis and configured to confine ions radially about the axis. The second multipole assembly includes a second plurality of rod electrodes arranged about the axis and configured to confine the ions radially about the axis. An orientation of the first multipole assembly about the axis is rotationally offset relative to an orientation of the second multipole assembly about the axis.

In some examples, the orientation of the first multipole assembly about the axis is rotationally offset relative to the orientation of the second multipole assembly about the axis such that a rod electrode included in the first plurality of rod electrodes overlaps with two rod electrodes included in the second plurality of rod electrodes, as viewed in a direction along the axis. Alternatively, the orientation of the first multipole assembly about the axis is rotationally offset relative to the orientation of the second multipole assembly about the axis such that a rod electrode included in the first plurality of rod electrodes does not overlap with any rod electrodes included in the second plurality of rod electrodes, as viewed in the direction along the axis.

The configurations of the multipole assemblies described herein may provide various benefits, including allowing the size and complexity of mass spectrometers to be reduced without degrading the performance of the mass spectrometers. In order to reduce the size and simplify the construction of a mass spectrometer, ion optic elements positioned between adjacent multipole assemblies may be eliminated. For example, eliminating lenses (e.g., conductance-limiting lenses) positioned in the interface between an ion transfer device and a mass analyzer may reduce the number of needed voltages and driving circuitry as well as lead to improved ion transfer efficiency through these stages. However, the inventors have discovered that lenses positioned in the interface between adjacent multipole assemblies not only limit conductance of gas between the different vacuum stages of the ion source and mass analyzer but also shield each multipole assembly from RF coupling of voltages applied to the multipole assemblies. Such RF coupling on a multipole assembly could be detrimental to the overall performance of the mass spectrometer.

The configurations of multipole assemblies described herein allow ion optics (e.g., lenses) to be eliminated from the interface between adjacent multipole assemblies while at the same time reducing or eliminating unwanted RF coupling on the multipole assemblies. For example, the offset orientation of the first multipole assembly relative to the orientation of the second multipole assembly reduces the amount of overlap between electrodes in the first plurality of electrodes and the second plurality of electrodes as compared with conventional configurations. The reduced overlap reduces the voltage that is capacitively coupled to the electrodes of the first and second multipole assemblies. As a result, a conductance-limiting lens (such as a Turner-Kruger lens) may be omitted from the interface between the multipole assemblies, thereby enabling a smaller, more compact design of the mass spectrometer. In some examples, omission of a conductance-limiting lens from the interface between adjacent multipole assemblies may also increase the transmission of ions between the multipole assemblies.

Various embodiments will now be described in more detail with reference to the figures. The exemplary systems and apparatuses described herein may provide one or more of the benefits mentioned above and/or various additional and/or alternative benefits that will be made apparent herein.

FIG. 1 illustrates functional components of an exemplary mass spectrometry system 100 ("system 100"). System 100 is illustrative and not limiting. As shown, system 100 includes an ion source 102, an ion transfer device 104, a mass analyzer 106, and a controller 108.

Ion source 102 is configured to produce a plurality of ions 110 from a sample to be analyzed. Ion source 102 may use any suitable ionization technique, including but not limited to electron ionization (EI), chemical ionization (CI), matrix assisted laser desorption/ionization (MALDI), electrospray ionization (ESI), atmospheric pressure chemical ionization (APCI), atmospheric pressure photoionization (APPI), inductively coupled plasma (ICP), and the like. Ion transfer device 104 may focus ions 110 into an ion beam 112 and accelerate ion beam 112 to mass analyzer 106.

Mass analyzer 106 is configured to separate the ions in ion beam 112 according to the ratio of mass to charge of each of the ions. To this end, mass analyzer 106 may include a quadrupole mass filter, an ion trap (e.g., a three-dimensional (3D) quadrupole ion trap, a cylindrical ion trap, a linear quadrupole ion trap, a toroidal ion trap, an orbitrap, etc.), a time-of-flight (TOF) mass analyzer, an electrostatic trap mass analyzer, a Fourier transform ion cyclotron resonance (FT-ICR) mass analyzer, a sector mass analyzer, and/or any other suitable type of mass analyzer. In some examples, a multipole assembly included in mass analyzer 106 is segmented.

In some embodiments that implement tandem mass spectrometers, mass analyzer 106 and/or ion source 102 may also include a collision cell. The term "collision cell," as used herein, is intended to encompass any structure arranged to produce product ions via controlled dissociation processes and is not limited to devices employed for collisionally-activated dissociation. For example, a collision cell may be configured to fragment the ions using collision induced dissociation (CID), electron transfer dissociation (ETD), electron capture dissociation (ECD), photo induced dissociation (PID), surface induced dissociation (SID), and any other suitable technique. A collision cell may be positioned upstream from a mass filter, which separates the fragmented ions based on the ratio of mass to charge of the ions. In some embodiments, mass analyzer 106 may include a combination of multiple mass filters and/or collision cells, such as a triple quadrupole mass analyzer, where a collision cell is interposed in the ion path between independently operable mass filters.

Mass analyzer 106 may further include an ion detector configured to detect separated ions and responsively generate a signal representative of ion abundance. In one example, mass analyzer 106 emits an emission beam of separated ions to the ion detector, which is configured to detect the ions in the emission beam and generate or provide data that can be used to construct a mass spectrum of the sample. The ion detector may include, but is not limited to, an electron multiplier, a Faraday cup, and/or any other suitable detector.

Ion source 102, ion transfer device 104, and/or mass analyzer 106 may include ion optics for focusing, accelerating, and/or guiding ions (e.g., ion beam 112) through system 100. The ion optics may include, for example, an ion guide, a focusing lens, a deflector, a funnel, and/or any other suitable device. For instance, ion transfer device 104 may focus the produced ions 110 into ion beam 112, accelerate ion beam 112, and guide ion beam 112 toward mass analyzer 106.

System 100 (e.g., any one or more of ion source 102, ion transfer device 104, and mass analyzer 106) may include various multipole assemblies each having a plurality of rod electrodes, as will be described below in more detail. Each such multipole assembly may, for example, form all or part of an ion transfer device, a mass analyzer (e.g., a mass filter), an ion trap, a collision cell, and/or ion optics (e.g., an ion guide). The multipole assembly may be coupled to an oscillatory voltage power supply configured to supply an RF voltage to the plurality of rod electrodes. The multipole assembly may also be coupled to a DC power supply configured to supply, for example, a mass resolving DC voltage to the plurality of rod electrodes.

Controller 108 may be communicatively coupled with, and configured to control operations of, ion source 102, ion transfer device 104, and/or mass analyzer 106. Controller 108 may include hardware (e.g., a processor, circuitry, etc.) and/or software configured to control operations of the various components of system 100. For example, controller 108 may be configured to enable/disable ion source 102. Controller 108 may also be configured to control the oscillatory voltage power supply and the DC power supply to supply the RF voltage and the mass resolving DC voltage, respectively, to a multipole assembly. Controller 108 may also be configured to control mass analyzer 106 by selecting an effective range of the ratio of mass to charge of ions to detect. Controller 108 may further be configured to adjust the sensitivity of the ion detector, such as by adjusting the gain, or to adjust the polarity of the ion detector based on the polarity of the ions being detected.

Figure 2A:
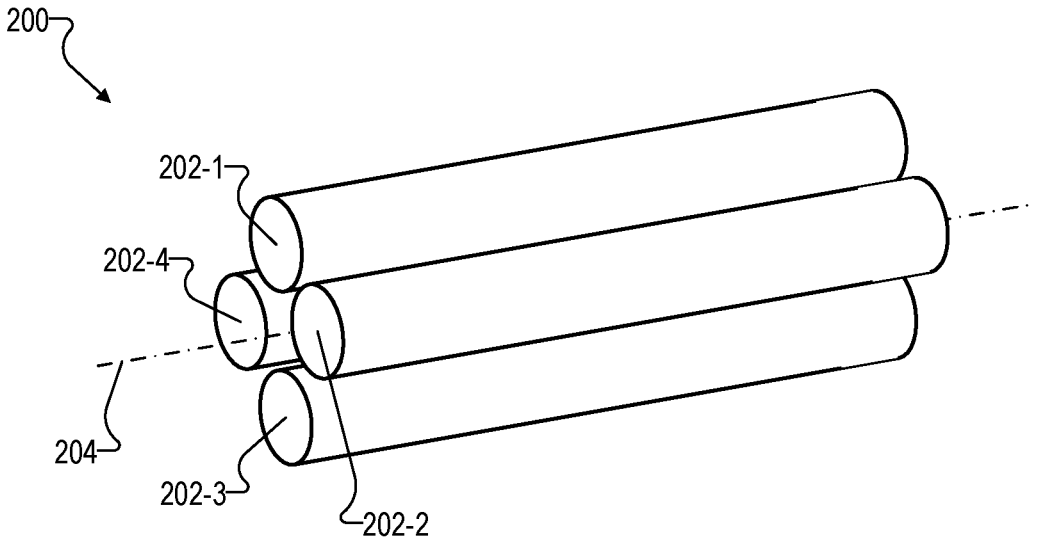
FIG. 2A illustrates a perspective view of an exemplary multipole assembly that may be included within the mass spectrometer system of FIG. 1.
Figure 2B:
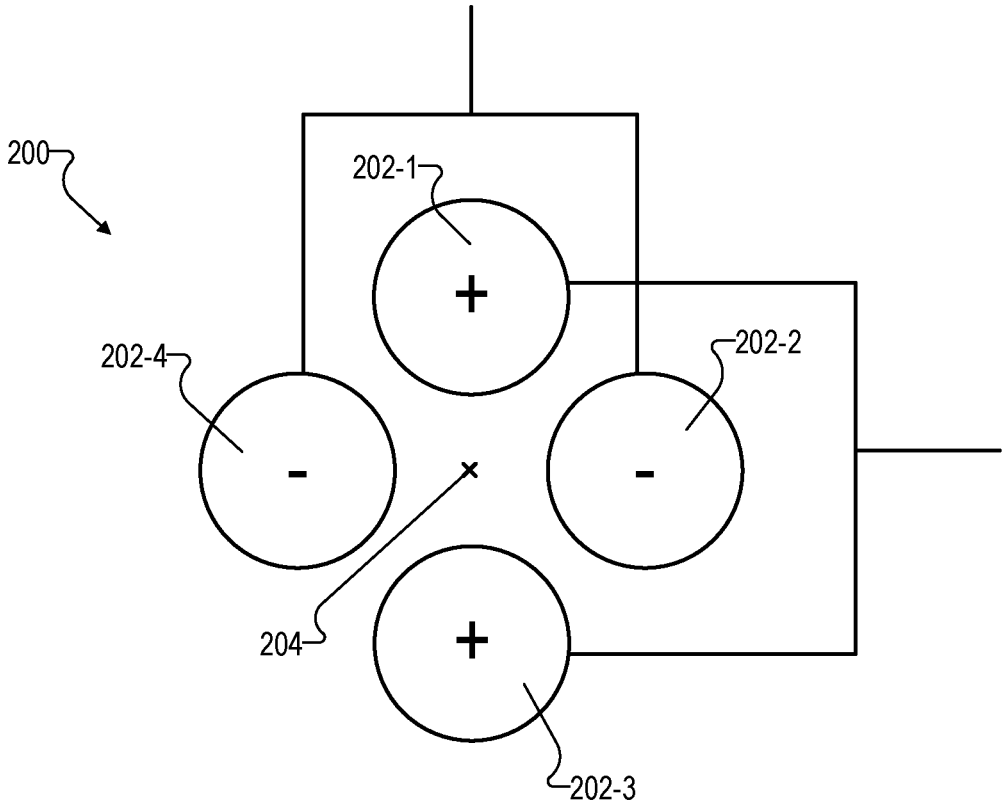
FIG. 2B illustrates a cross-sectional view of the multipole assembly shown in FIG. 2A.

FIGS. 2A and 2B illustrate an exemplary multipole assembly 200 that may be used in system 100 (e.g., as an ion guide in ion source 102, as ion transfer device 104, as a mass filter in mass analyzer 106, as a collision cell in mass analyzer 106, etc.). FIG. 2A shows a perspective view of multipole assembly 200, and FIG. 2B shows a cross-sectional view of multipole assembly 200. Multipole assembly 200 is a quadrupole having four elongate rod electrodes 202 (e.g., first electrode 202-1, second electrode 202-2, third electrode 202-3, and fourth electrode 202-4) arranged about an axis 204 extending along a longitudinal trajectory of electrodes 202. It will be recognized, however, that multipole assembly 200 may alternatively be configured as any other type of multipole assembly having a larger number of electrodes, such as a hexapole assembly having six electrodes, an octupole assembly having eight electrodes, or any other multipole assembly having any other suitable number of electrodes. Additionally, multipole assembly 200 may also be segmented as may suit a particular implementation.

Electrodes 202 may be formed of any conductive material, such as a metal (e.g., molybdenum, nickel, titanium), a metal alloy (e.g., invar, steel), and/or any other conductive material. As shown in FIG. 2, electrodes 202 are round (e.g., circular). However, it will be recognized that electrodes 202 may have any other cross-sectional shape as may suit a particular implementation (e.g., triangular, parabolic, rectangular, elliptical, etc.). Multipole assembly 200 may also include other components as may suit a particular implementation, such as support members (not shown) to hold electrodes 202 in a substantially mutual parallel alignment about axis 204 and electrical leads by which an RF voltage and/or a DC voltage are supplied to electrodes 202.

As shown in FIG. 2B, electrodes 202 are arranged as opposing electrode pairs across axis 204. For example, a first electrode pair includes first electrode 202-1 and third electrode 202-3, and a second electrode pair includes second electrode 202-2 and fourth electrode 202-4. When multipole assembly 200 is used in a mass spectrometry system (e.g., system 100), opposite phases of an RF voltage may be applied to the first and second pairs of electrodes 202 to generate an RF quadrupolar electric field that confines (e.g., guides or traps) ions radially about axis 204 such that the ions do not contact or discharge against any electrodes 202. As the RF voltage oscillates, the ions are alternately attracted to the first electrode pair and the second electrode pair, thus confining the ions radially about axis 204.

In some embodiments, multipole assembly 200 may function as a mass resolving multipole assembly configured to separate ions based on their ratio of mass to charge. Accordingly, a mass resolving DC voltage may also be applied to the electrode pairs, thereby superposing a constant electric field on the RF quadrupolar electric field. The constant electric field generated by the mass resolving DC voltage causes the trajectory of ions having a ratio of mass to charge outside of an effective stability range to become unstable such that the unstable ions eventually discharge against one of the electrodes 202 and are not detected by the ion detector. Only ions having a ratio of mass to charge within the effective stability range maintain a stable trajectory in the presence of the mass resolving DC voltage and are confined radially about axis 204, thus separating such ions to be detected by the ion detector.

The quality of the data generated by a mass spectrometry system in which multipole assembly 200 is used depends on the precision of the RF and/or DC electric fields generated by electrodes 202. As the ions in multipole assembly 200 approach the stability range limits, small frequency interferences on electrodes 202 can make these ions unstable, thereby leading to transmission losses and mass peak defects.

Figure 3A:
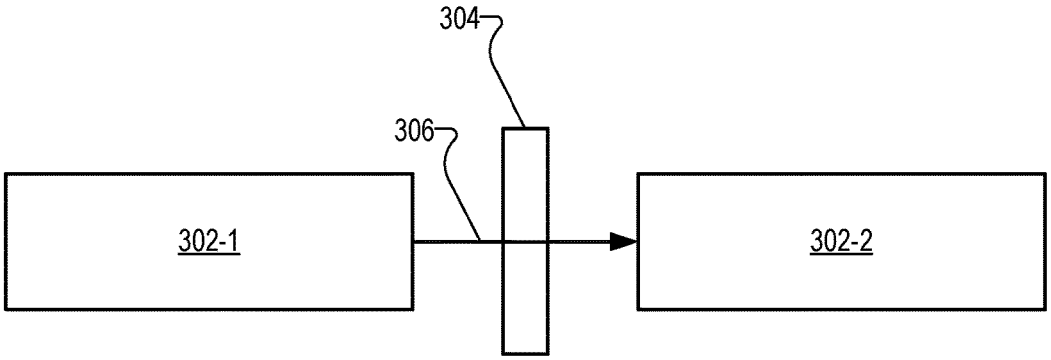
FIG. 3A illustrates a functional diagram of an exemplary configuration in which a first multipole assembly and a second multipole assembly are positioned adjacent to one another.

FIG. 3A shows a functional diagram of a conventional configuration in which a first multipole assembly 302-1 (e.g., an ion guide) and a second multipole assembly 302-2 (e.g., a mass filter) are positioned adjacent to one another end-to-end along an axis of multipole assemblies 302 (e.g., along axis 204). A lens 304 (e.g., a Turner-Kruger lens) is positioned in the interface between multipole assemblies 302 to limit conductance of gas from one vacuum stage to another vacuum stage. Ion beam 306 (e.g., ion beam 112) exits first multipole assembly 302-1 (e.g., ion transfer device 104), passes through lens 304, and enters second multipole assembly 302-2 (e.g., mass analyzer 106).

Figure 3B:
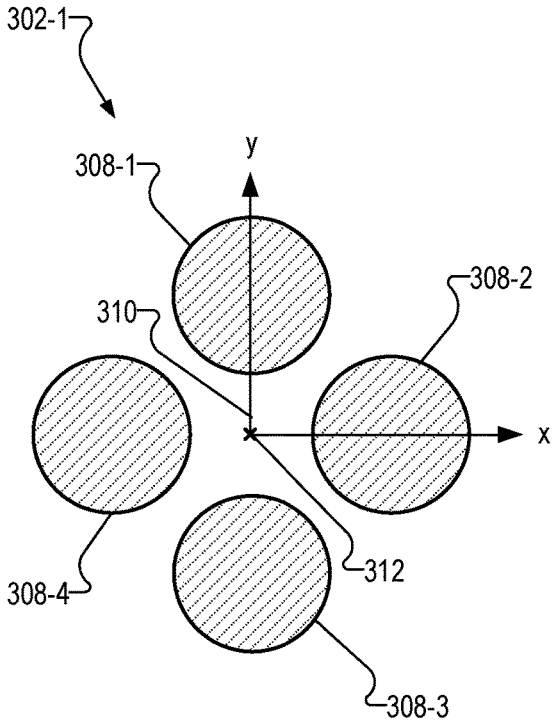
FIGS. 3B and 3C illustrate cross-sectional views of exemplary configurations of the first multipole assembly and the second multipole assembly shown in FIG. 3A.
Figure 3C:
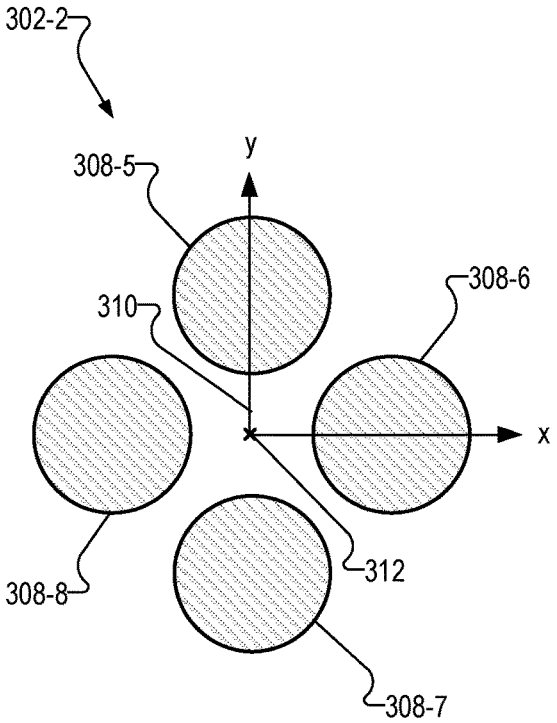

FIGS. 3B and 3C illustrate cross-sectional views of exemplary configurations of multipole assemblies 302-1 and 302-2, respectively, and show an orientation of multipole assemblies 302-1 and 302-2 relative to a common reference frame 310. As shown, first multipole assembly 302-1 includes a first plurality of rod electrodes 308-1 through 308-4 arranged about an axis 312, and second multipole assembly 302-2 includes a second plurality of rod electrodes 308-5 through 308-8 arranged about axis 312. A z-axis of reference frame 310 corresponds to axis 312 of multipole assemblies 302, and an x-axis and a y-axis of reference frame 310 are orthogonal to the z-axis and to one another.

As can be seen, the orientation of first multipole assembly 302-1 and the orientation of second multipole assembly 302-2 relative to reference frame 310 are substantially the same. That is, the y-axis extends through the centers of electrodes 308-1, 308-3, 308-5, and 308-7, and the x-axis extends through the centers of electrodes 308-2, 308-4, 308-6, and 308-8. Accordingly, electrode 308-1 is positioned directly across from electrode 308-5 in the z-direction, electrode 308-2 is directly across from electrode 308-6 in the z-direction, and so forth. As a result, the RF voltage applied to electrodes 308-1 through 308-4 of first multipole assembly 302-1 may capacitively couple to electrodes 308-5 through 308-8 of second multipole assembly 302-2 (and vice versa). This coupled signal could create undesirable transmission losses, especially as the ions transverse the gap between first multipole assembly 302-1 and second multipole assembly 302-2. For example, the RF voltage applied to electrode 308-1 may capacitively couple to electrode 308-5, the RF voltage applied to electrode 308-2 may capacitively couple to electrode 308-6, and so forth. As mentioned above, lens 304 may, in addition to limiting conductance of gas, shield multipole assemblies 302 from such RF coupling, but lens 304 takes up space, needs drive electronics, and, in some cases, may also cause ion transmission losses.

Various configurations of multipole assemblies that facilitate the removal of lenses in the interface between adjacent multipole assemblies while substantially reducing and/or eliminating the capacitive coupling between adjacent multipole assemblies will now be described. It will be recognized that the embodiments that follow are merely exemplary and are not limiting.

Figure 4A:
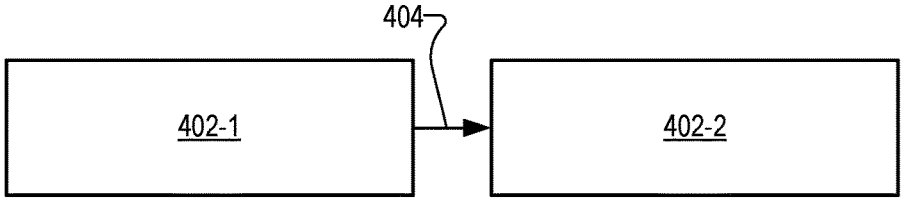
FIG. 4A illustrates a functional diagram of another exemplary configuration in which a first multipole assembly and a second multipole assembly are positioned adjacent to one another.

FIG. 4A shows a functional diagram of an exemplary configuration in which a first multipole assembly 402-1 and a second multipole assembly 402-2 are positioned adjacent to one another end-to-end along an axis of multipole assemblies 402. Multipole assemblies 402 may be implemented by any suitable multipole assembly described herein (e.g., multipole assembly 200). Ion beam 404 exits first multipole assembly 402-1 and enters second multipole assembly 402-2. In the example shown in FIG. 4A, no lens is positioned in the interface between multipole assemblies 402. Without an intervening lens, multipole assemblies 402 may be spaced apart by no more than approximately 5.0 mm and no less than approximately 0.5 mm. In other examples, multipole assemblies 402 may be spaced apart by no more than approximately 3.0 mm and no less than approximately 0.5 mm. In yet other examples, multipole assemblies 402 may be spaced apart by no more than approximately 3.0 mm and no less than approximately 1.0 mm. It should be noted that, when multipole assemblies 402 are spaced apart by less than 0.5 mm, the high voltages applied to the multipole assemblies 402 may begin to break down. In alternative examples, a lens may be positioned in the interface between multipole assemblies 402 for limiting conductance of gas between different vacuum stages.

Figure 4B:
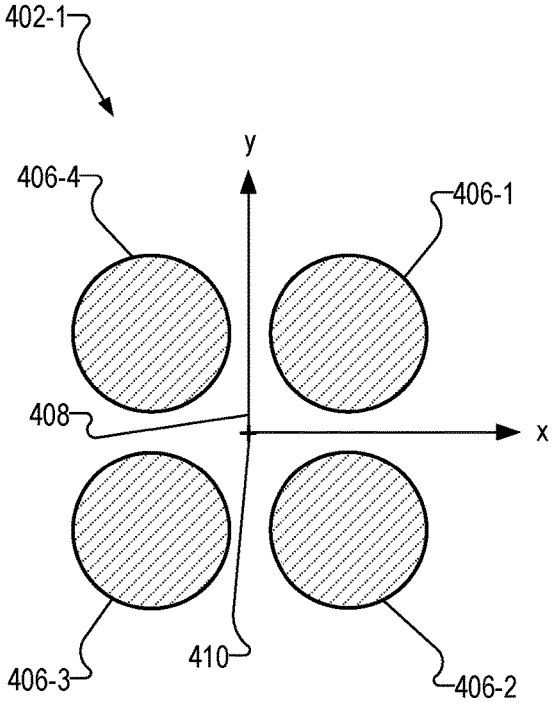
FIGS. 4B and 4C illustrate cross-sectional views of an exemplary configuration of the first multipole assembly and the second multipole assembly shown in FIG. 4A.
Figure 4C:
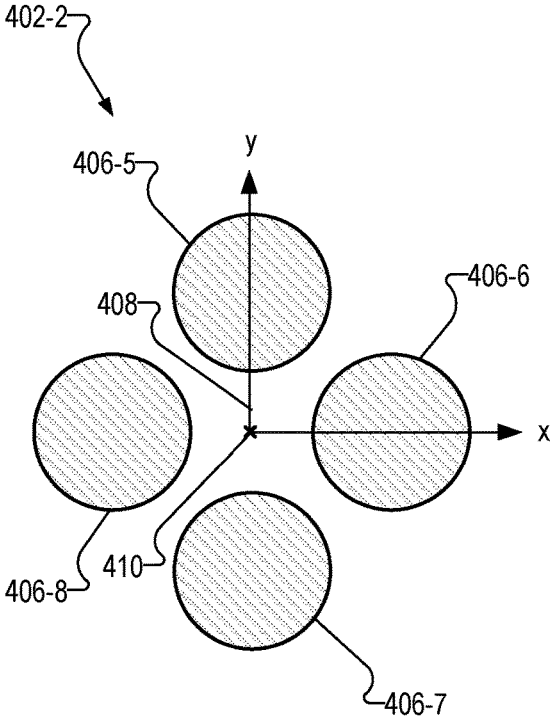

FIGS. 4B and 4C illustrate cross-sectional views of exemplary configurations of multipole assemblies 402-1 and 402-2, respectively. As shown, multipole assembly 402-1 is implemented as a quadrupole having four rod electrodes 406-1 through 406-4, and multipole assembly 402-2 is also implemented as a quadrupole having four rod electrodes 406-5 through 406-8. However, multipole assemblies 402 may be implemented by any other suitable multipole assembly (e.g., a hexapole, an octupole, etc.) as may suit a particular implementation. Additionally, first multipole assembly 402-1 and/or second multipole assembly 402-2 may be segmented as may suit a particular implementation. A multipole assembly that is segmented at the ion entrance side (e.g., RF-only at the ion entrance side) may focus the incoming ions and reduce ion interactions, thereby reducing or even eliminating the need for a conductance-limiting lens.

Figure 5:
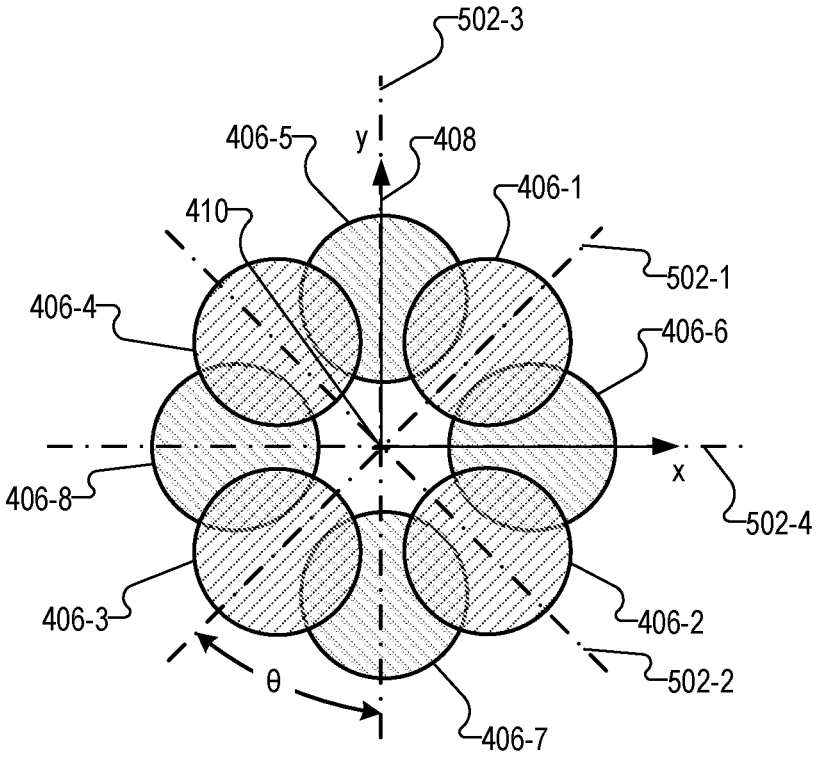
FIG. 5 shows the cross-sectional views of FIGS. 4B and 4C superimposed on one another.

FIGS. 4B and 4C show an orientation of multipole assemblies 402 relative to one another and to a common reference frame 408. FIG. 5 shows the cross-sectional views of FIGS. 4B and 4C superimposed on one another. As shown in FIGS. 4B and 4C and FIG. 5, the z-axis of reference frame 408 corresponds to an axis 410 of multipole assemblies 402, and the x-axis and the y-axis are orthogonal to the z-axis and to one another. The orientation of reference frame 408 has been arbitrarily fixed based on the orientation of electrodes 406-5 through 406-8 of second multipole assembly 402-2. That is, the x-axis passes through centers of electrodes 406-6 and 406-8 and the y-axis passes through centers of electrodes 406-5 and 406-7.

As can be seen in FIGS. 4B and 4C and FIG. 5, the orientation of first multipole assembly 402-1 about axis 410 is rotationally offset about axis 410 relative to the orientation of second multipole assembly 402-2 about axis 410. For example, the orientation of rod electrodes 406-1 through 406-4 included in first multipole assembly 402-1 is rotationally offset about axis 410 relative to the orientation of rod electrodes 406-5 through 406-8 included in second multipole assembly 402-2.

In some examples, the orientation of first multipole assembly 402-1 is rotationally offset relative to the orientation of second multipole assembly 402-2 when each electrode 406 of a pair of opposing electrodes 406 is positioned such that the electrode's center does not overlap with the center of another electrode, as viewed along axis 410.

In additional or alternative examples, the orientation of first multipole assembly 402-1 is rotationally offset relative to the orientation of second multipole assembly 402-2 when an imaginary line that passes through the center of each electrode 406 (or through the center of an electrode surface facing axis 410) of a pair of opposing electrodes 406 included in first multipole assembly 402-1 is not coterminous with any imaginary line that passes through the center of each electrode 406 (or through the center of an electrode surface facing axis 410) of a pair of opposing electrodes 406 included in second multipole assembly 402-2.

For example, as shown in FIG. 5, a first imaginary line 502-1 passes through the centers of opposing electrodes 406-1 and 406-3 of first multipole assembly 402-1, and a second imaginary line 502-2 passes through the centers of opposing electrodes 406-2 and 406-4 of first multipole assembly 402-1. Similarly, a third imaginary line 502-3 (e.g., the y-axis of reference frame 408) passes through the centers of opposing electrodes 406-5 and 406-7 of second multipole assembly 402-2, and a fourth imaginary line 502-4 (e.g., the x-axis of reference frame 408) passes through the centers of opposing electrodes 406-6 and 406-8 of second multipole assembly 402-2. As shown in FIG. 5, first multipole assembly 402-1 is rotationally offset relative to second multipole assembly 402-2 such that first imaginary line 502-1 is not coterminous with third imaginary line 502-3 or with fourth imaginary line 502-4.

The orientation of first multipole assembly 402-1 about axis 410 may be rotationally offset relative to the orientation of second multipole assembly 402-2 about axis 410 by any suitable amount. In some examples, the amount of offset satisfies the following relationship:

$$0 < \theta < \frac{360°}{n}$$

where θ is the offset angle between an imaginary line of first multipole assembly 402-1 (e.g., first imaginary line 502-1 or second imaginary line 502-2) and a nearest imaginary line of second multipole assembly 402-2 (e.g., third imaginary line 502-3 or fourth imaginary line 502-4), as viewed in the z-direction, and n is the number of electrodes in second multipole assembly 402-2. For example, where second multipole assembly 402-2 is a quadrupole (n=4), the offset angle θ between first imaginary line 502-1 of first multipole assembly 402-1 and third imaginary line 502-3 of second multipole assembly 402-2 may be greater than 0° but less than 90°. Where second multipole assembly 402-2 is an octupole (n=8), the offset angle θ between first imaginary line 502-1 of first multipole assembly 402-1 and third imaginary line 502-3 of second multipole assembly 402-2 may be greater than 0° but less than 45°.

In some examples, the orientation of first multipole assembly 402-1 about axis 410 is rotationally offset relative to the orientation of second multipole assembly 402-2 about axis 410 such that at least one electrode 406 included in first multipole assembly 402-1 (e.g., electrode 406-1) overlaps with two electrodes 406 included in second multipole assembly 402-2 (e.g., electrodes 406-5 and 406-6), as viewed in a direction along the axis (e.g., the z-direction). Additionally or alternatively, the orientation of first multipole assembly 402-1 about axis 410 is rotationally offset relative to the orientation of second multipole assembly 402-2 about axis 410 such that at least one electrode 406 included in second multipole assembly 402-2 (e.g., electrode 406-5) overlaps with two electrodes 406 included in first multipole assembly 402-1 (e.g., electrodes 406-1 and 406-4), as viewed in the z-direction. With such a configuration, capacitive coupling on the overlapping electrodes 406 included in multipole assemblies 402 may be reduced, as compared with the configurations of FIGS. 3A-3C, because capacitance is proportional to the amount of overlapping surface area.

In some examples, the orientation of first multipole assembly 402-1 about axis 410 is rotationally offset relative to the orientation of second multipole assembly 402-2 about axis 410 such that at least one electrode 406 included in first multipole assembly 402-1 (e.g., electrode 406-1) overlaps with two electrodes 406 included in second multipole assembly 402-2 (e.g., electrodes 406-5 and 406-6) by substantially equal amounts, as viewed in the z-direction. This may be accomplished, for example, by setting the offset angle θ as follows:

$$\theta = \frac{360°}{2n}$$

In the example shown in FIG. 5, n=4, so the offset angle θ is 45°. With such configuration, the net voltage capacitively coupled to a single electrode 406 in a multipole assembly 402 that overlaps with two electrodes 406 in the other multipole assembly 402 is approximately zero. This is because the two overlapping electrodes 406 are driven with RF voltages of opposite phases, and thus the overlapping surface areas generate equal but opposite RF displacement currents. Even if the amount of overlap is not exactly equal, the net voltage capacitively coupled to an electrode 406 is substantially reduced as compared with the configurations of FIGS. 3A-3C.

Figure 6A:
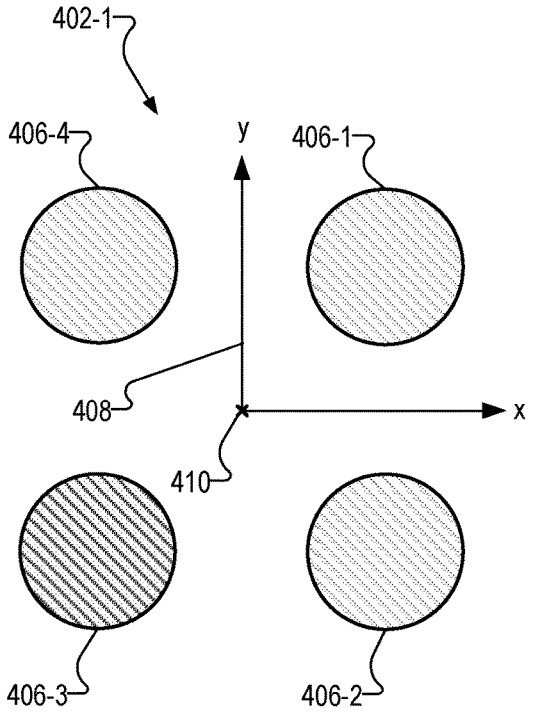
FIGS. 6A-6C illustrate another exemplary configuration of a first multipole assembly and a second multipole assembly positioned adjacent to one another.
Figure 6B:
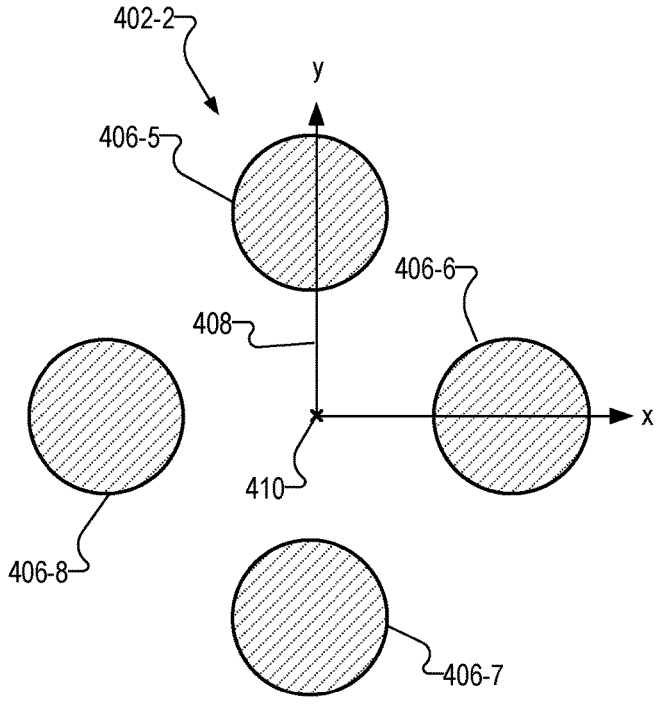
Figure 6C:
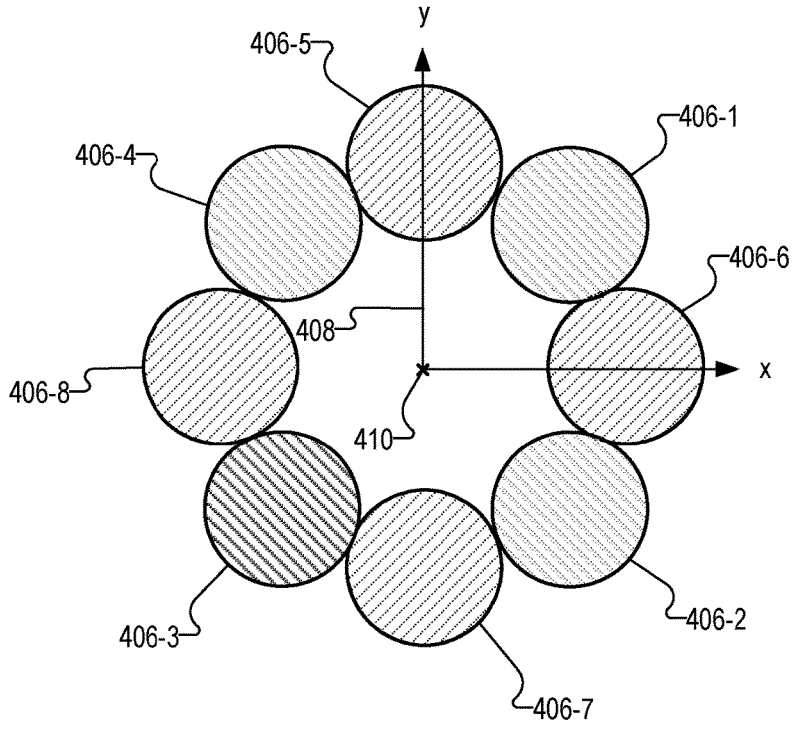

FIGS. 6A-6C illustrate another exemplary configuration of multipole assemblies 402 in which the orientation of first multipole assembly 402-1 is rotationally offset such that no electrodes 406 overlap with one another, as viewed in the z-direction. FIGS. 6A-6C are similar to FIGS. 4B, 4C, and 5, respectively, except that the cross-sectional surface area of each electrode 406 included in first multipole assembly 402-1 is smaller than the gaps between adjacent electrodes 406 in second multipole assembly 402-2. Accordingly, the orientation of first multipole assembly 402-1 about axis 410 is rotationally offset relative to the orientation of second multipole assembly 402-2 about axis 410 such that at least one of electrodes 406-1 through 406-4 does not overlap with any of electrodes 406-5 through 406-8, as viewed in the z-direction. In this way, capacitive coupling between multipole assemblies 402 may be completely eliminated or substantially reduced.

Figure 7A:
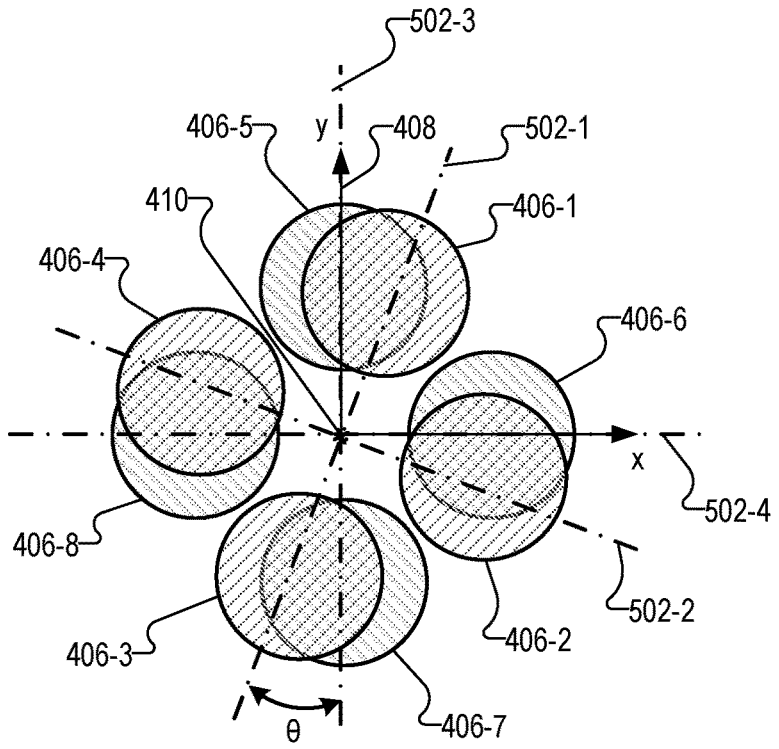
FIGS. 7A and 7B illustrate additional exemplary configurations of a first multipole assembly and a second multipole assembly positioned adjacent to one another.

FIG. 7A illustrates another exemplary configuration of multipole assemblies 402. FIG. 7A is similar to FIG. 5 except that at least one electrode 406 included in first multipole assembly 402-1 (e.g., electrodes 406-1) partially overlaps with only one electrode 406 included in second multipole assembly 402-2 (e.g., electrodes 406-5), as viewed in the z-direction. With such a configuration, capacitive coupling on the overlapping electrodes 406 included in multipole assemblies 402 may be reduced as compared with the configurations of FIGS. 3A-3C.

Figure 7B:
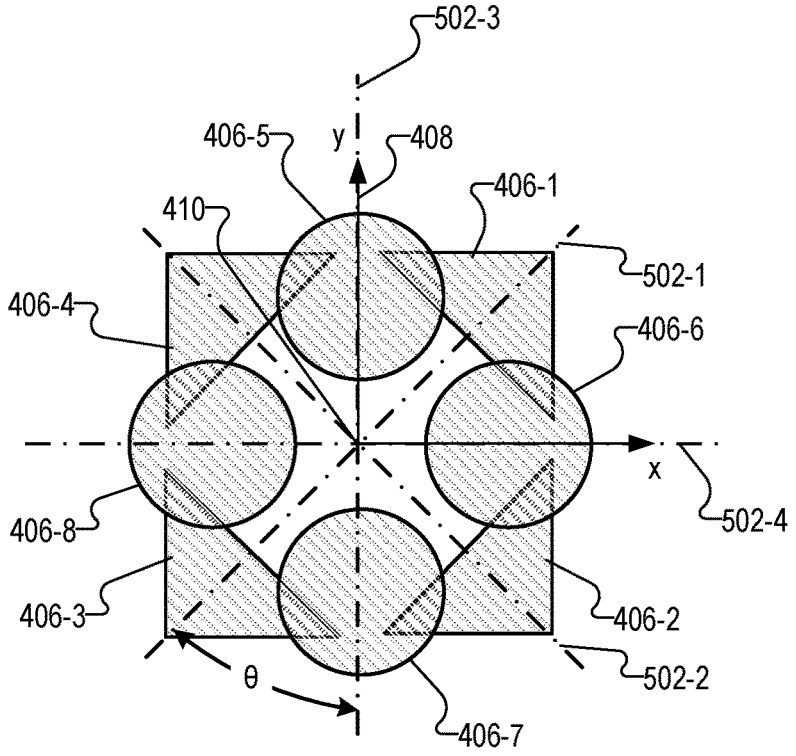

FIG. 7B illustrates another exemplary configuration of multipole assemblies 402. FIG. 7B is similar to FIG. 5 except that electrodes 406-1 through 406-4 of first multipole assembly 402-1 have a different cross-sectional shape than electrodes 406-5 through 406-8 of second multipole assembly 402-2, as viewed in the z-direction. Even with different shaped electrodes 406, capacitive coupling on each electrode 406 included in multipole assemblies 402 may be reduced as compared with the configurations of FIGS. 3A-3C.

Figure 8:
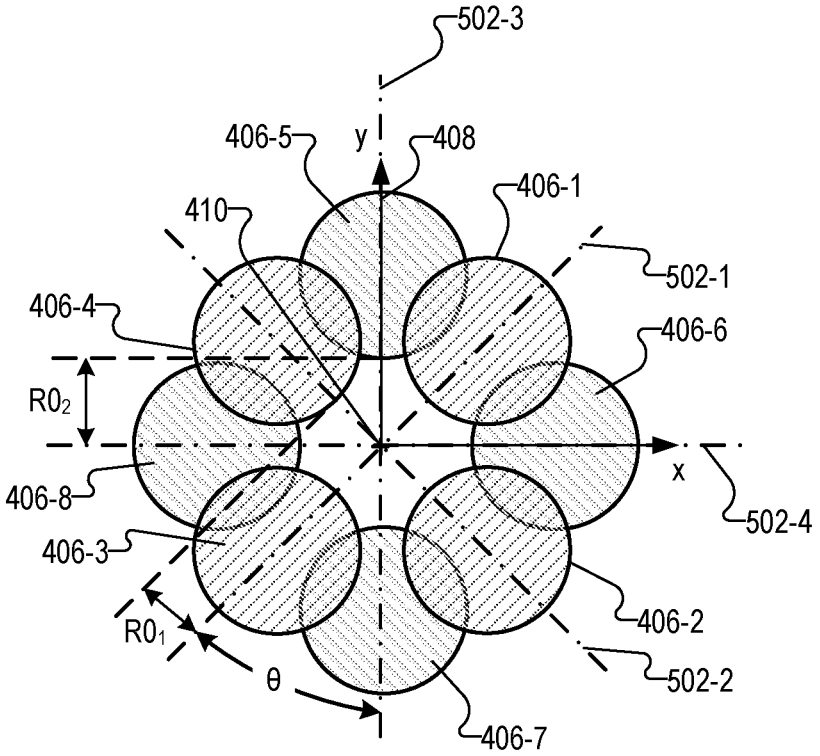
FIG. 8 illustrates another exemplary configuration of a first multipole assembly and a second multipole assembly positioned adjacent to one another.

In the examples described above, the orientation of first multipole assembly 402-1 about axis 410 is rotationally offset relative to the orientation of second multipole assembly 402-2 about axis 410. In additional or alternative embodiments, as shown in FIG. 8, electrodes 406-1 through 406-4 included in first multipole assembly 402-1 may be radially offset relative to electrodes 406-5 through 406-8 included in second multipole assembly 402-2. FIG. 8 is similar to FIG. 5 except that electrodes 406-1 through 406-4 of first multipole assembly 402-1 are closer to axis 410 than are electrodes 406-5 through 406-8. That is, the distance $R0_1$ (i.e., the distance from axis 410 to the nearest axis-facing surface of the electrode) of first multipole assembly 402-1 is smaller than the distance $R0_2$ of second multipole assembly 402-2. Such configuration may further reduce the amount of overlapping surface area of electrodes 406 as compared with the configurations of FIGS. 3A-3C and thereby further decrease capacitive coupling between electrodes 406.

In some examples, a multipole assembly (e.g., first multipole assembly 402-1) may be configured such that an orientation of the multipole assembly about an axis of the multipole assembly is offset relative to an orientation of another multipole assembly (e.g., second multipole assembly 402-2) in a mass spectrometer when the multipole assembly is disposed adjacent to the other multipole assembly in the mass spectrometer. For example, structures on the multipole assembly (e.g., a support frame, electrical leads, screw holes, etc.) for mounting and installing the multipole assembly may be specifically configured (shaped, structured, positioned, etc.) for the offset orientation.

Figure 9:
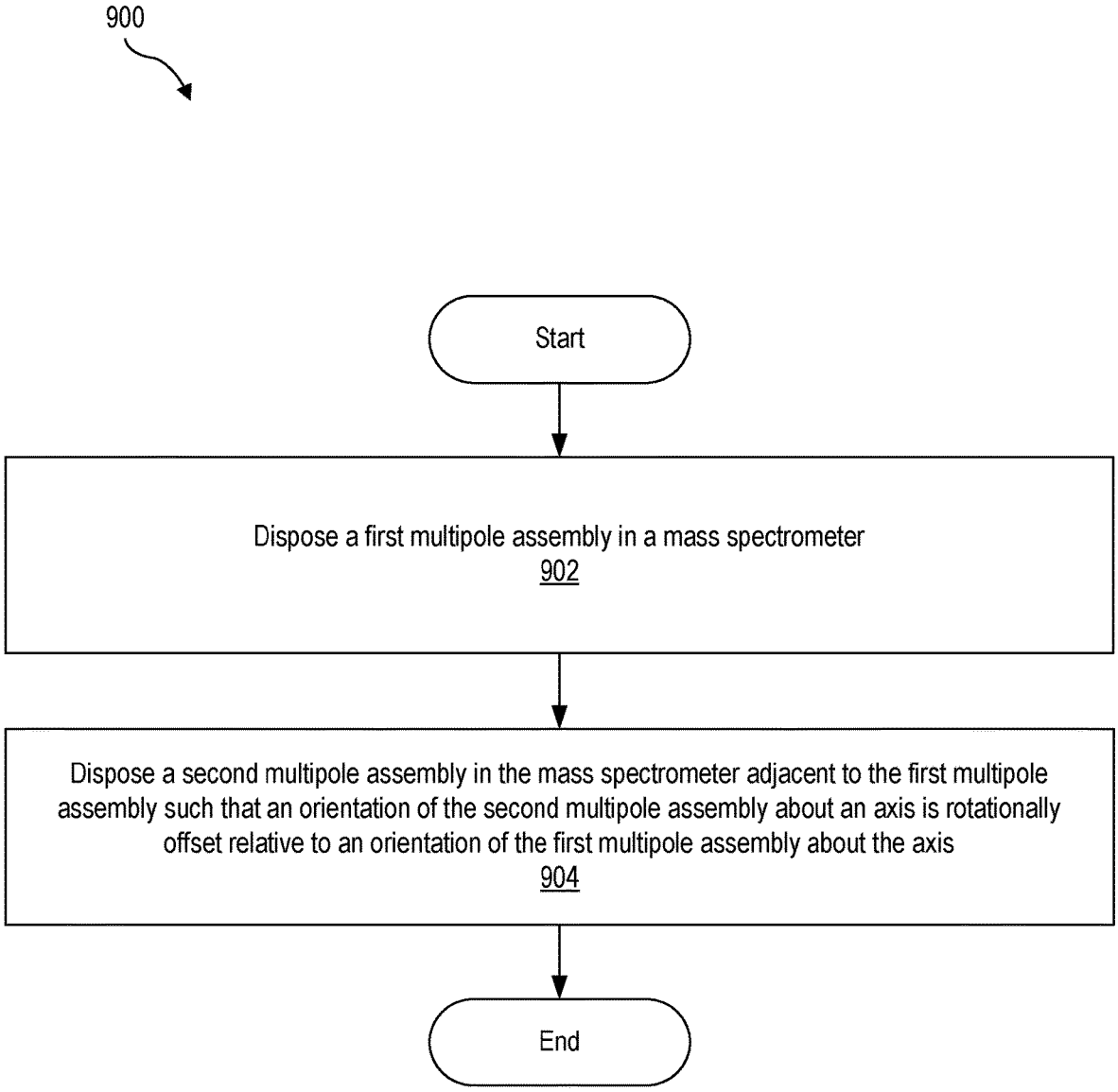
FIG. 9 illustrates an exemplary block diagram of a method for disposing a first multipole assembly in a mass spectrometer adjacent to a second multipole assembly in the mass spectrometer.

The multipole assembly configurations described above can be easily arranged in a mass spectrometer system (e.g., system 100). FIG. 9 illustrates an exemplary block diagram of a method for disposing a multipole assembly in a mass spectrometer. While FIG. 9 illustrates exemplary steps according to one embodiment, other embodiments may omit, add to, reorder, combine, and/or modify any of the steps shown in FIG. 9.

In step 902, a first multipole assembly is disposed in a mass spectrometer. The first multipole assembly includes a first plurality of rod electrodes arranged about an axis and configured to confine ions radially about the axis.

In step 904, a second multipole assembly is disposed in the mass spectrometer adjacent to the first multipole assembly. The second multipole assembly includes a second plurality of rod electrodes arranged about the axis and configured to confine the ions radially about the axis. The second multipole assembly is disposed in the mass spectrometer such that an orientation of the second multipole assembly about the axis is rotationally offset relative to an orientation of the first multipole assembly about the axis.

Various modifications may be made to the systems and configurations described above. For example, in the configurations described above the multipole assemblies have the same number of rod electrodes. However, in other configurations the multipole assemblies may have different numbers of rod electrodes. For instance, a first multipole assembly may be an octupole ion guide and the second multipole assembly may be a quadrupole mass filter. Additionally, in the configurations described above first multipole assembly 402-1 is shown and described as being positioned upstream from second multipole assembly 402-2. In other examples, first multipole assembly 402-1 may be positioned downstream from second multipole assembly 402-2. In yet another modification, offset orientations may be used in a series of multipole assemblies. For example, an orientation of an ion guide (Q0) may be offset relative to an orientation of a first quadrupole mass filter (Q1), an orientation of the first quadrupole mass filter (Q1) may be offset relative to an orientation of a collision cell (Q2), and an orientation of the collision cell (Q2) may be offset relative to an orientation of a second mass filter (Q3).

More generally, in the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A mass spectrometer comprising:

a first multipole assembly comprising a first plurality of electrodes arranged about an axis and configured to confine ions radially about the axis, and a second multipole assembly adjacent to the first multipole assembly and comprising a second plurality of electrodes arranged about the axis and configured to confine the ions radially about the axis, wherein an orientation of the first multipole assembly about the axis is rotationally offset relative to an orientation of the second multipole assembly about the axis such that an electrode included in the first plurality of electrodes overlaps with two electrodes included in the second plurality of electrodes, as viewed in a direction along the axis.

2. The mass spectrometer of claim 1, wherein an amount of overlap of the electrode included in the first plurality of electrodes that overlaps with each of the two electrodes included in the second plurality of electrodes is substantially the same, as viewed in the direction along the axis.

3. The mass spectrometer of claim 1, wherein the orientation of the first multipole assembly about the axis is rotationally offset relative to the orientation of the second multipole assembly about the axis such that a net voltage capacitively coupled to an electrode included in the first plurality of electrodes by the second plurality of electrodes is approximately zero.

4. The mass spectrometer of claim 1, wherein an orientation of the first plurality of electrodes about the axis is radially offset relative to the orientation of the second plurality of electrodes about the axis.

5. The mass spectrometer of claim 1, wherein each of the first multipole assembly and the second multipole assembly comprises an ion guide, a mass filter, an ion trap, or a collision cell.

6. The mass spectrometer of claim 1, further comprising an ion source and a mass analyzer, wherein the first multipole assembly is included in the ion source and the second multipole assembly is included in the mass analyzer.

7. The mass spectrometer of claim 1, wherein an interface between the first multipole assembly and the second multipole assembly does not include a lens.

8. The mass spectrometer of claim 1, wherein the first multipole assembly and the second multipole assembly are spaced apart by no more than approximately 5.0 millimeters and no less than approximately 0.5 millimeters.

9. The mass spectrometer of claim 1, wherein the first multipole assembly and the second multipole assembly are spaced apart by no more than approximately 3.0 millimeters and no less than approximately 0.5 millimeters.

10. A multipole assembly configured for use in a mass spectrometer, the multipole assembly comprising:

a first multipole assembly comprising a first plurality of electrodes arranged about an axis and configured to confine ions radially about the axis; and a second multipole assembly comprising a second plurality of electrodes arranged about the axis and configured to confine the ions radially about the axis, wherein an orientation of the first multipole assembly about the axis is rotationally offset relative to an orientation of the second multipole assembly about the axis such that an electrode included in the first plurality of electrodes overlaps with two electrodes included in the second plurality of electrodes, as viewed in a direction along the axis.

11. The multipole assembly of claim 10, wherein an amount of overlap of the electrode included in the first plurality of electrodes that overlaps with each of the two electrodes included in the second plurality of electrodes is substantially the same, as viewed in the direction along the axis.

12. The multipole assembly of claim 10, wherein the orientation of the first multipole assembly about the axis is rotationally offset relative to the orientation of the second multipole assembly about the axis such that a net voltage capacitively coupled to an electrode included in the first plurality of electrodes by the second plurality of electrodes is approximately zero.

13. The multipole assembly of claim 10, wherein an orientation of the first plurality of electrodes about the axis is radially offset relative to the orientation of the second plurality of electrodes about the axis.

14. The multipole assembly of claim 10, further comprising an ion guide, a mass filter, an ion trap, or a collision cell.

15. A method comprising:

disposing a first multipole assembly in a mass spectrometer, the first multipole assembly comprising a first plurality of electrodes arranged about an axis and configured to confine ions radially about the axis; and disposing a second multipole assembly in the mass spectrometer adjacent to the first multipole assembly, the second multipole assembly comprising a second plurality of electrodes arranged about the axis and configured to confine the ions radially about the axis, wherein the second multipole assembly is disposed in the mass spectrometer such that an orientation of the second multipole assembly about the axis is rotationally offset relative to an orientation of the first multipole assembly about the axis such that an electrode included in the second plurality of electrodes overlaps with two electrodes included in the first plurality of electrodes, as viewed in a direction along the axis.

16. The mass spectrometer of claim 1, wherein the electrodes of at least one of the first plurality of electrodes and the second plurality of electrodes are rod electrodes.

17. The mass spectrometer of claim 16, wherein the electrodes of the first plurality of electrodes and the second plurality of electrodes are rod electrodes.

18. The multipole assembly of claim 10, wherein the electrodes of at least one of the first plurality of electrodes and the second plurality of electrodes are rod electrodes.

19. The multipole assembly of claim 18, wherein the electrodes of the first plurality of electrodes and the second plurality of electrodes are rod electrodes.

20. The method of claim 15, wherein the electrodes of the first plurality of electrodes and the second plurality of electrodes are rod electrodes.

* * * * *